US006354055B1

(12) United States Patent
Shaw et al.

(10) Patent No.: US 6,354,055 B1
(45) Date of Patent: Mar. 12, 2002

(54) METHOD AND APPARATUS FOR BUILDING ROOF CONSTRUCTION

(76) Inventors: Elbert W. Shaw, 0802 E. 300 N.; James W. Shaw, 3893 N. 100 W., both of La Porte, IN (US) 46350

( * ) Notice: Subject to any disclaimer, the term of this patent is extended or adjusted under 35 U.S.C. 154(b) by 0 days.

(21) Appl. No.: 09/387,966

(22) Filed: Sep. 1, 1999

(51) Int. Cl.[7] ..... E04B 1/38; E04C 5/18
(52) U.S. Cl. ..... 52/712; 52/696
(58) Field of Search ..... 52/712, 696

(56) References Cited

U.S. PATENT DOCUMENTS 2,964,807 A * 12/1960 Kenndy ..... 52/696
3,298,151 A * 1/1967 Jureit ..... 52/696 X
3,334,461 A * 8/1967 York ..... 52/696 X
4,021,990 A * 5/1977 Schwalberg ..... 52/712 X
4,246,736 A * 1/1981 Kovar et al. ..... 52/712 X
4,490,956 A * 1/1985 Palacio et al. ..... 52/712 X
4,570,407 A * 2/1986 Palacio et al. ..... 52/712 X
4,604,845 A * 8/1986 Brinker ..... 52/696
4,637,195 A * 1/1987 Davis ..... 52/696 X
D293,416 S * 12/1987 Krueger ..... 52/696 X
D318,785 S * 8/1991 Dean ..... 52/696 X
RE34,022 E * 8/1992 Davis ..... 52/696 X
5,551,200 A * 9/1996 Krug ..... 52/696
5,606,837 A * 3/1997 Holizlander ..... 52/696 X
5,884,448 A * 3/1999 Pellock ..... 52/696 X
5,899,042 A * 5/1999 Pellock ..... 52/712 X

* cited by examiner

*Primary Examiner*—Peter M. Cuomo
*Assistant Examiner*—Rodney B. White
(74) *Attorney, Agent, or Firm*—Ryan M. Fountain

(57) ABSTRACT

A rafter assembly is provided for joining each adjacent pair of trusses by linkage members that precisely define the predetermined spacing required between the trusses, support the trusses against relative motion apart, and include integral truss penetrating projections for initial attachment and conventional fastener alignment means for accommodating permanent connection fasteners. Further, the linkage members are configured and mountable on the trusses so as to provide no interference with the attachment of the structural members creating the roof surface.

2 Claims, 1 Drawing Sheet

METHOD AND APPARATUS FOR BUILDING ROOF CONSTRUCTION

BACKGROUND AND SUMMARY OF THE INVENTION

The present invention relates generally to construction of roofs for buildings, and, more particularly, to methods for mounting preassembled rafters to a building to support a site-built roof surface.

In construction of either mobile or static buildings, roofs have generally been built by either the use of "stick built" rafters or prefabricated rafter trusses. In either case, the rafters are usually first positioned with respect to each other and the lower portion of the building they are to cover along the entire area to be covered by the roof. Once all or substantially all of the rafters are in place, the structural material for the roof surface, often sheets of plywood, are attached to the rafters.

Prefabricated rafter trusses are becoming more and more commonly used due to the reduced cost and construction time they can provide. By "prefabricated," it is meant that the rafter trusses are initially assembled from multiple structural members, usually 2×4 lumber members, at a location remote from the site of the building being constructed, and then transported to the construction site for installation on the building as a completed unit via a crane or like machinery.

Unlike with stick built roofs, when using prefabricated rafter trusses, there is typically no central ridgebeam to which they are mounted and spaced as each rafter is put in place. Given the weight and size of such trusses, it is important to maintain proper orientation and spacing as each truss is brought to the roof. Previously, workers have had to carefully measure the spacing and plumb of each truss as it was lifted and placed over the building by the crane. Once satisfied of the truss location, full lengths of construction grade 2×4 lumber were typically nailed to each adjacent truss to temporarily hold it in place. Unfortunately, in such situations there is often no safe platform for the roof workers to stand on when holding that relatively large and heavy 2×4 at the ready, measuring the truss position and then holding the 2×4 in place while nailing it to each of the trusses. Thus, some imprecision could be introduced in truss position or hazardous environment created for the worker as a result, particularly during placement of the initial trusses.

Further, the 2×4s were only a temporary form of truss retention. As the sheets of plywood were permanently secured to each truss, additional labor was required to have the 2×4s removed and set aside. Thus, nail perforated lumber was often found strewn about the workplace, creating yet another hazard for workers, visitors and casual trespassers frequently attracted to the construction site. In addition, this lumber was often permanently discarded as waste and not used for any other purpose, if for no other reason than the effort required to remove the nails initially placed in it for the trusses.

Obviously, in each aspect, there have been methods of correcting these deficiencies of construction practice. Unfortunately, it was often the case that the high cost of labor time to correct these deficiencies effectively precluded remedy by that route.

Accordingly, it is an object of the present invention to provide an improved method and apparatus from the construction of building roofs. Other objects include the provision of a roof construction arrangement that:

a. is less costly in terms of both material and labor expenses, b. utilizes less hazardous construction methods, c. provides more accurate placement and retention of roof rafters, d. is less wasteful of environmental resources, and e. is easier to apply and can be permanently affixed to the building.

These and other objects are attained by the provision of a rafter assembly for joining each adjacent pair of trusses by linkage members that precisely define the predetermined spacing required between the trusses, support the trusses against relative motion apart, and include integral truss penetrating projections for initial attachment and conventional fastener alignment means for accommodating permanent connection fasteners. Further, the linkage members are configured and mountable on the trusses so as to provide no interference with the attachment of the structural members creating the roof surface.

Other objects, advantages and novel features of the present invention will now become readily apparent to those of skill in this technology from consideration of the attached drawings and detailed description of certain preferred embodiments.

DETAILED DESCRIPTION OF PREFERRED EMBODIMENTS

Figure 1:
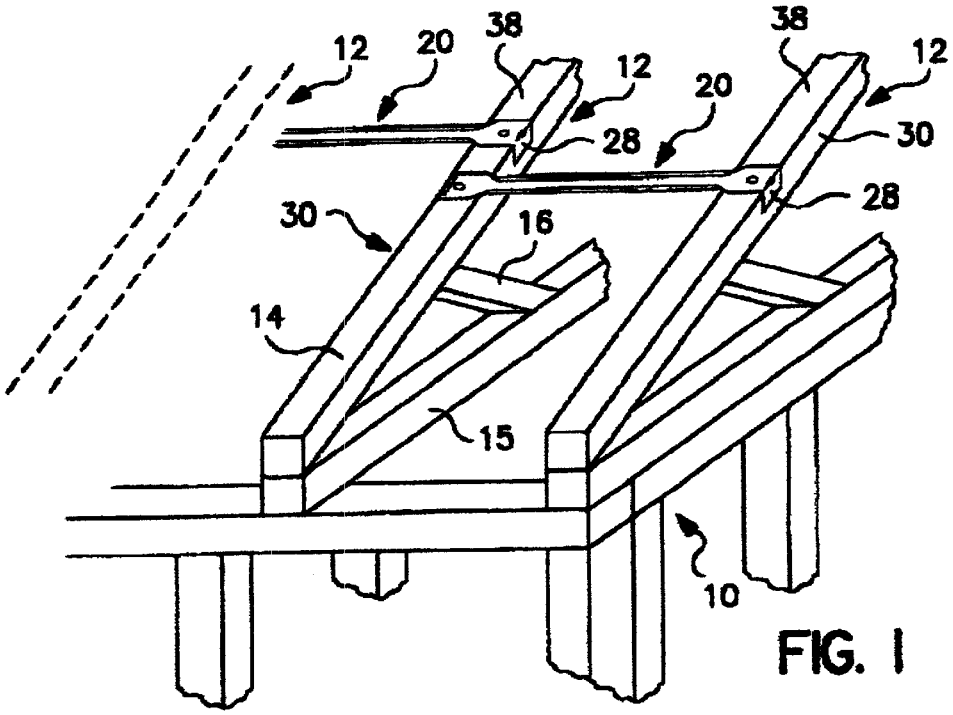
FIG. 1 shows a top, right perspective view of a portion of a roof rafter arrangement according to the teachings of the present invention.
Figure 2:
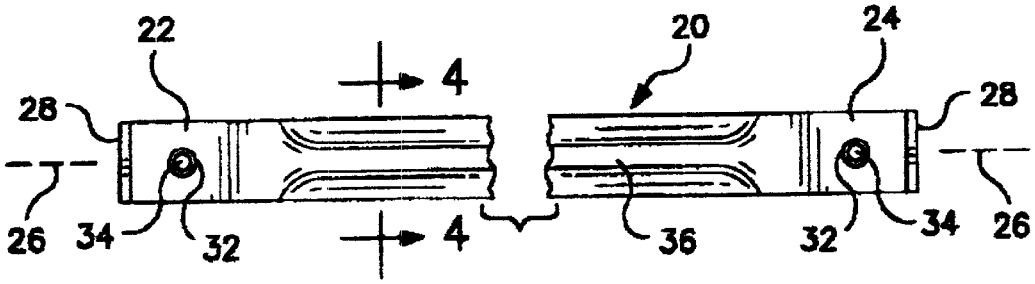
FIG. 2 shows an enlarged, bottom plan view of the linkage member of FIG. 1.
Figure 3:
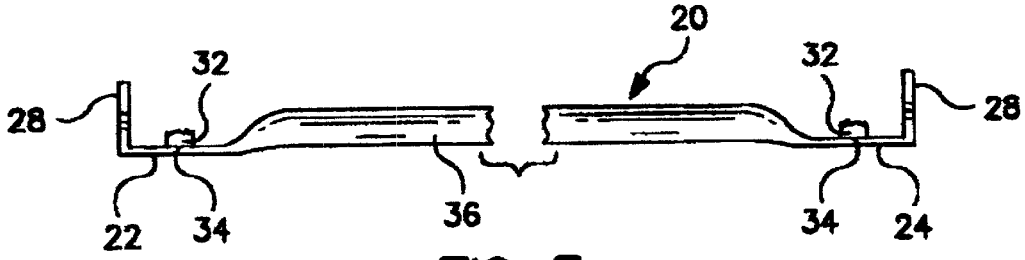
FIG. 3 shows a side view of the linkage member of FIG. 2.
Figure 4:
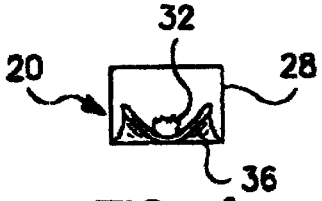
FIG. 4 shows a further enlarged cross-sectional view of the linkage member of FIG. 1, as taken along line 4—4.

FIG. 1 illustrates a preferred embodiment of the present invention as applied to roof rafter trusses. The specific truss structure is conventional, as is the lower portion of the building. Thus, these features are only shown in rudimentary form. Also, while only two such exemplary trusses are shown specifically, it will be understood that the linkage member of the present invention is intended to be applicable to all or substantially all such trusses of the entire roof structure.

In FIG. 1, the lower portion of the building is shown with structural framework 10 upon which a plurality of spaced-apart roof rafter trusses 12, framework or the like are placed. Trusses 12 are each, for example, preassembled sections formed from a plurality of individual structural members 14, 15, 16 and so forth. Those structural members are, for example, 2×4 lumber cut to desired length and shape and fixed together at a location remote from the building site where the trusses will ultimately be used. As is conventional, structural material, such as sheets of plywood, will be overlayed and secured to the trusses when the overall rafter framework is completed.

The present invention includes linkage members 20, a least one of which is secured to each pair of adjacent trusses 12. Preferably, each linkage member 20 is formed from a length of relatively rigid and light-weight sheet metal or plastic material only slightly longer than the spacing desired between rafters, typically 24 inches "on center" in standard roof constructions. Thus, multiple linkage members 20 can be easily handled or even pocketed by workers in elevated locations at the rafter site.

Each linkage member 20 is, for example formed with a first end 22 and second end 24, extending along a longitudinal axis 26. At each of ends 22 and 24, a projection 28 is formed to extend away from axis 26. Where linkage 20 is formed from a length of sheet metal, projections 28 can be formed by bending the terminal portions of the length to a generally orthogonal position. The length of projections 28 can be as desired for a particular application, but it has been found that only approximately one inch of such projection is necessary in many circumstances for the linkage member to function adequately.

However, the distance between projections 28 should be carefully measured to correspond to precisely the desired separation of trusses 12, allowing for the width of the material used in the trusses. The allowance for that width is needed since, in preferred embodiments, linkage member 20 is positioned to overlay each adjacent truss 12, with projections 28 extending downwardly closely along the opposite, outward side 30 of each truss 12. By extending projections 28 in this matter, linkage member 20 restricts movement of trusses 12 apart from each other once the trusses are positioned on the building. Given that each linkage member is used in a similar manner in adjacent pairs of such trusses, the overall arrangement or system of linkage members also serves to restrict motion of the trusses toward each other, since that could only result from movement of the trusses apart from the next adjacent trusses, which is blocked by the next linkage member.

Linkage members 20 also include penetrating projections 32 adjacent each of ends 22 and 24. Projections 32 are positioned at their respective ends so as to engage a surface of the truss overlayed by that end of the linkage member. Preferably, projections 32 are integrally formed on the linkage members, as by a deforming punch through a portion of the linkage member, so that no addition fastener need be held by the worker during installation. Thus, by simply pounding the end of the linkage member in place with a hammer, the linkage member can be initially secured to the truss beneath that end.

Linkage members 20 further include a means to accommodate permanent attachment to the trusses by conventional fasteners, such as nails. For this purpose, apertures 34 are formed in linkage members 20 adjacent each of ends 22 and 24. Apertures 34 facilitate alignment of the nails with the trusses and penetration of the linkage member by the nails to the trusses. In especially preferred embodiments, apertures 34 are formed by the same deforming punch as creates projections 32.

To facilitate economical manufacture and minimize the dimensions of linkage members 20, a rigidifying bend 36 or crease may, for example, be formed along the length of the linkage member intermediate ends 22 and 24. The particular configuration of this bend can be as desired according to the rigidity needed for a particular application with a given material thickness, as is generally conventional.

In practice, linkage members 20 can be placed at any desired location on adjacent trusses 12, and not merely on top surfaces 38, as shown. Where the linkage members are mounted on the top surfaces of the rafters, it has been found that the relatively thin nature of the linkage member does not interfere with the subsequent mounting of plywood sheets to the rafters in forming the roof surface.

Further, although the present invention has been described above with respect to specific embodiments, that was done by way of illustration and example only and not as a limitation to invention. Those of ordinary skill in the art will now realize that within the present invention numerous other modifications and adaptations of specific embodiments can be made. For example, although describe with respect to a static structure application, the present invention is similarly applicable to construction of mobile home roofs using related truss arrays. Accordingly, the spirit and scope of the present invention are limited only by the terms of the claims below.

What we claim is:

1. An arrangement for construction of a building at a building site using preassembled sections of spaced apart framework, comprising:

a first section of preassembled framework including multiple structural members secured together at a location remote from the building site, a second section of preassembled framework including multiple structural members secured together at a location remote from the building site, the first and second sections of preassembled framework being disposed in spaced apart orientation with respect to each other at the building site and aligned so that those sections will together support a third section, that third section being assembled at the building site, a linkage member connected to the first section and the second section with spacing means to define and maintain a predetermined distance between the first and section sections and bracing means to integrate and support the first and section sections against motion apart from each other during and until completion of the third section, the linkage member including at least one integral first means for attachment initially to each of the first and second sections and at least one multi-part second means for attachment subsequently to each of the first and second sections, each of the first means for attachment being paired with a second means for attachment and being co-located on the linkage member.

2. A linkage member to facilitate construction of a building roof, that roof being formed from a plurality of preassembled, spaced-apart rafter sections with sheets of structural material overlaying and bridging a plurality of such rafter sections, the rafter sections each being disposed on the building prior to overlaying by the sheets of structural material, the linkage member comprising:

spacing means for engaging two adjacent rafter sections on an outward side of those sections, relative to each other, and defining a lateral distance between them according to a predetermined standard, bracing means for engaging two adjacent rafter sections during disposition of the rafter sections on the building and supporting those sections against relative movement apart from each other, first attachment means integrally formed with the linkage member for initially securing the linkage member to each section, and second attachment means for permanently securing the linkage member to each section, the second attachment means being located on the linkage member at the same position as the first attachment means.

* * * * *